US010653229B1

(12) United States Patent
Brower

(10) Patent No.: US 10,653,229 B1
(45) Date of Patent: May 19, 2020

(54) BACKPACK LAP PILLOW APPARATUS

(71) Applicant: Glenn Brower, Dundee, FL (US)

(72) Inventor: Glenn Brower, Dundee, FL (US)

( * ) Notice: Subject to any disclaimer, the term of this patent is extended or adjusted under 35 U.S.C. 154(b) by 0 days.

(21) Appl. No.: 16/351,109

(22) Filed: Mar. 12, 2019

(51) Int. Cl.
*A45F 4/06* (2006.01)
*A45F 3/04* (2006.01)
*A45F 3/00* (2006.01)

(52) U.S. Cl.
CPC ..... *A45F 3/04* (2013.01); *A45F 2003/003* (2013.01); *A45F 2200/0583* (2013.01)

(58) Field of Classification Search
CPC .... A45F 4/026; A45F 4/06; A45F 3/04; A45F 2200/0583; A45F 2003/003; A47C 16/00; A47C 7/383; A47G 9/1045; A47G 9/1063
USPC ..... 224/155–156, 643
See application file for complete search history.

(56) References Cited

U.S. PATENT DOCUMENTS 5,961,019 A * 10/1999 Gleason ..... A45F 3/12 112/441
6,644,522 B2 * 11/2003 Preiss ..... A45F 3/12 224/264
7,367,483 B2 * 5/2008 Nassanian ..... A45F 3/12 224/264
7,748,064 B2 7/2010 Lamilton
D641,973 S 7/2011 Quelh
8,333,308 B2 * 12/2012 Maginness ..... A45F 3/04 224/153
8,678,253 B2 * 3/2014 Graham ..... A45F 3/047 224/155
8,985,693 B2 * 3/2015 Purpura ..... A45F 4/06 224/153
9,226,565 B1 * 1/2016 Martin ..... A45F 4/06
9,770,113 B1 * 9/2017 Miller ..... A47C 16/00
2002/0050009 A1 5/2002 Ley
2016/0367018 A1 12/2016 Soto-Camacho
2018/0132621 A1 * 5/2018 Scrimshaw ..... A47C 16/00

FOREIGN PATENT DOCUMENTS

WO WO2007068950 6/2007

* cited by examiner

*Primary Examiner* — Adam J Waggenspack

(57) ABSTRACT

A backpack lap pillow apparatus for providing a comfortable sleep solution while traveling includes a backpack body having a pair of shoulder straps. The pair of shoulder straps has a carry position and an alternate rest position inverting the pair of shoulder straps such that they extend around a top side and a front side of the backpack body. A U-shaped pillow is coupled to an inner side of each of the pair of shoulder straps proximal the top side. The pillow is positioned such that it wraps around the user's neck when the pair of shoulder straps is worn in the carry position and rests above the top side of the backpack body when the pair of shoulder straps is in the rest position, allowing the user to rest her head on the pillow with the backpack body in her lap.

19 Claims, 5 Drawing Sheets

BACKPACK LAP PILLOW APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to backpacks and more particularly pertains to a new backpack for providing a comfortable sleep solution while traveling.

BRIEF SUMMARY OF THE INVENTION

An embodiment of the disclosure meets the needs presented above by generally comprising a backpack body having a front side separated from a back side, a left side separated from a right side, and a top side separated from a bottom side forming an inner cavity. The inner cavity has a zippered access aperture extending through the left side, the top side, and the right side of the backpack body. A pair of shoulder straps is coupled to the backpack body and extends from the back side adjacent the top side to the right side and the left side adjacent the bottom side. The pair of shoulder straps has a carry position allowing the shoulder straps to be worn on a user's shoulders to carry the backpack body and an alternate rest position inverting the pair of shoulder straps such that they extend around the top side and the front side of the backpack body. A U-shaped pillow is coupled to an inner side of each of the pair of shoulder straps proximal the top side. The pillow is positioned such that it wraps around the user's neck when the pair of shoulder straps is worn in the carry position and rests above the top side of the backpack body when the pair of shoulder straps is in the rest position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
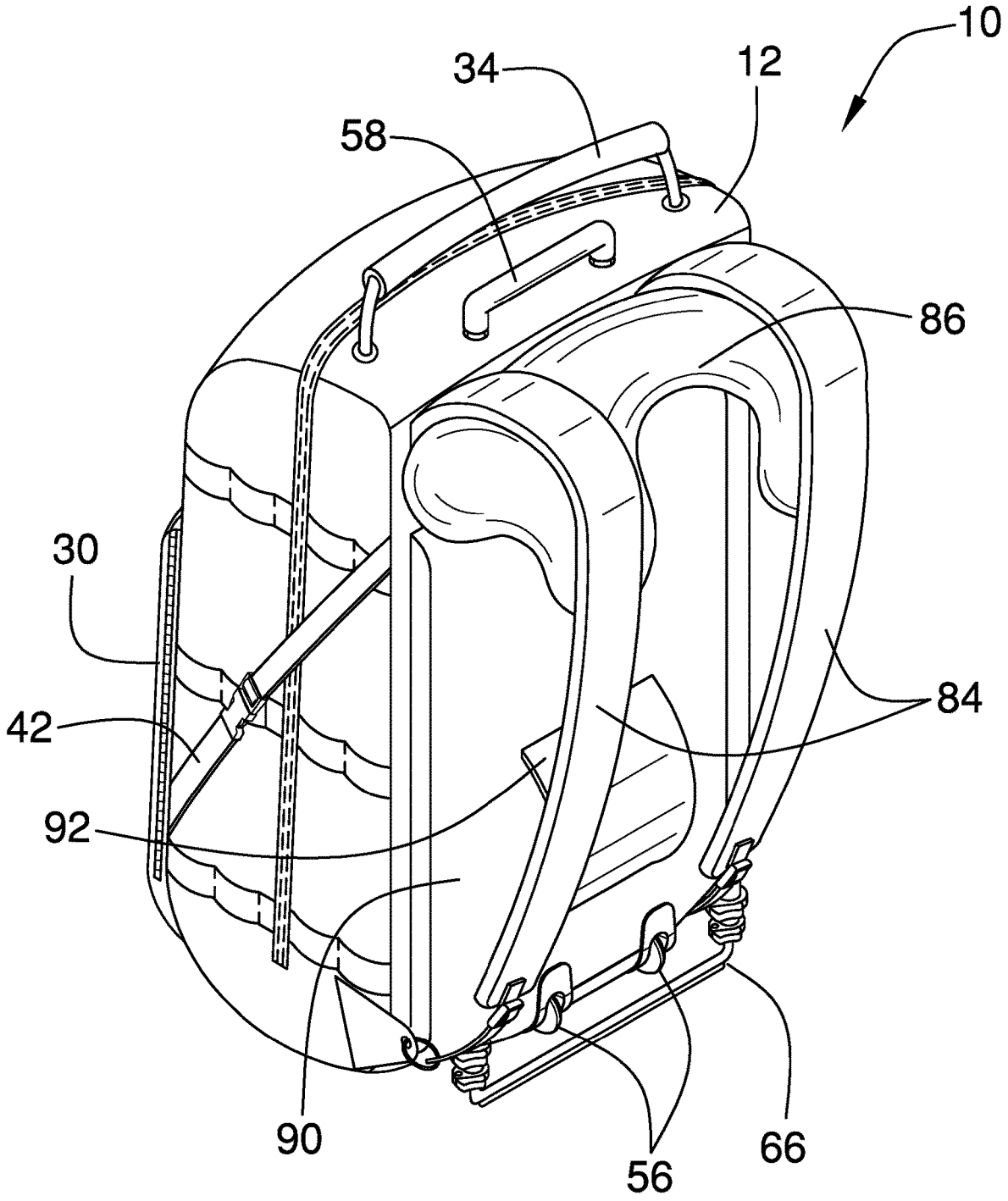
FIG. 1 is an isometric view of a backpack lap pillow apparatus according to an embodiment of the disclosure.
Figure 2:
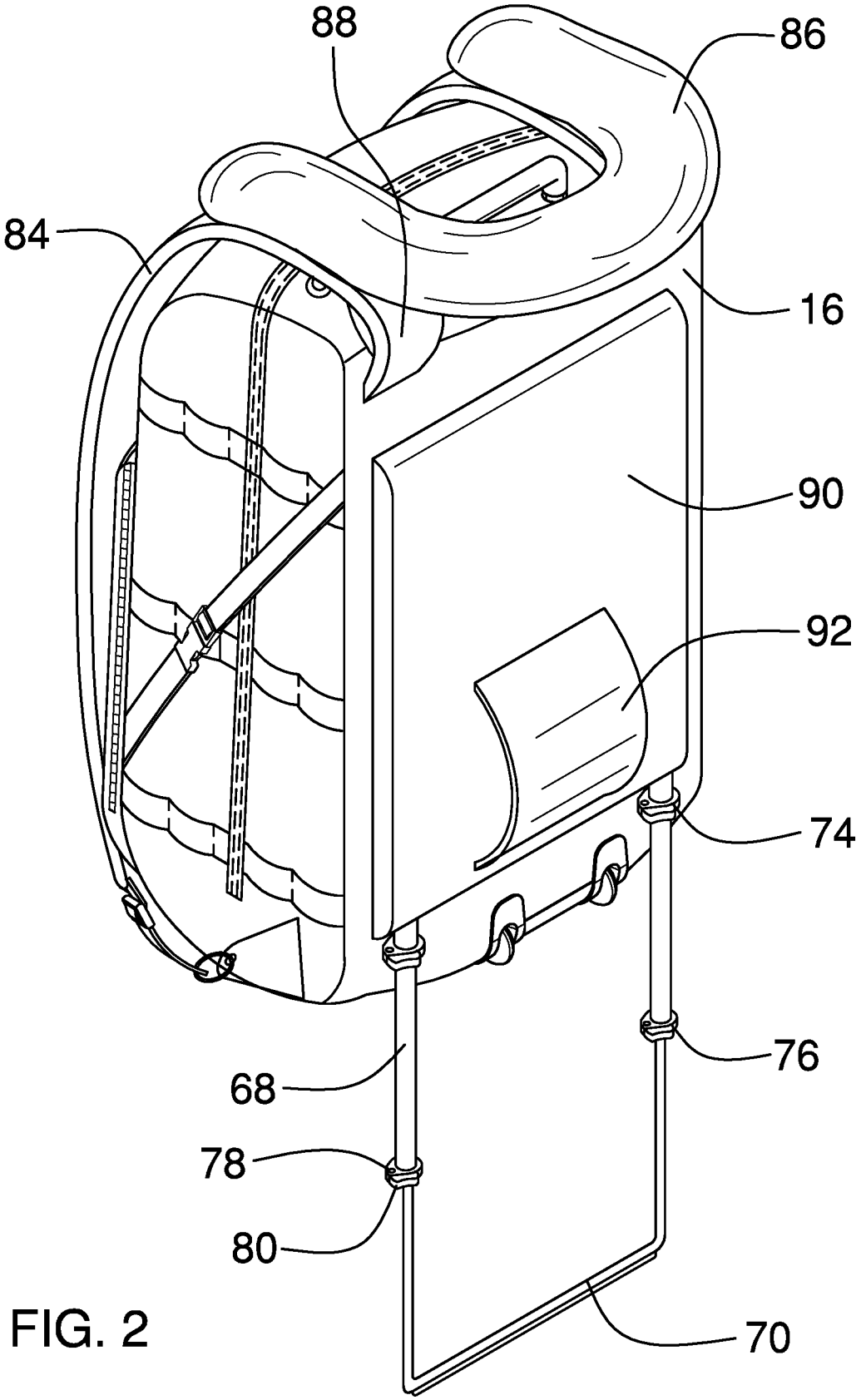
FIG. 2 is an isometric view of an embodiment of the disclosure.
Figure 4:
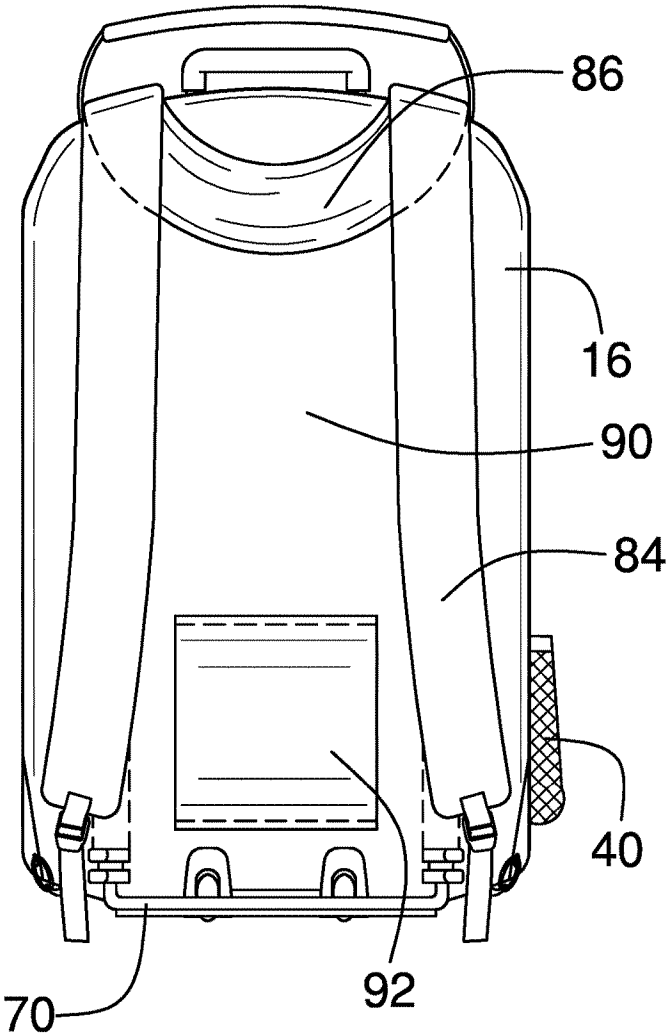
FIG. 4 is a rear elevation view of an embodiment of the disclosure.
Figure 3:
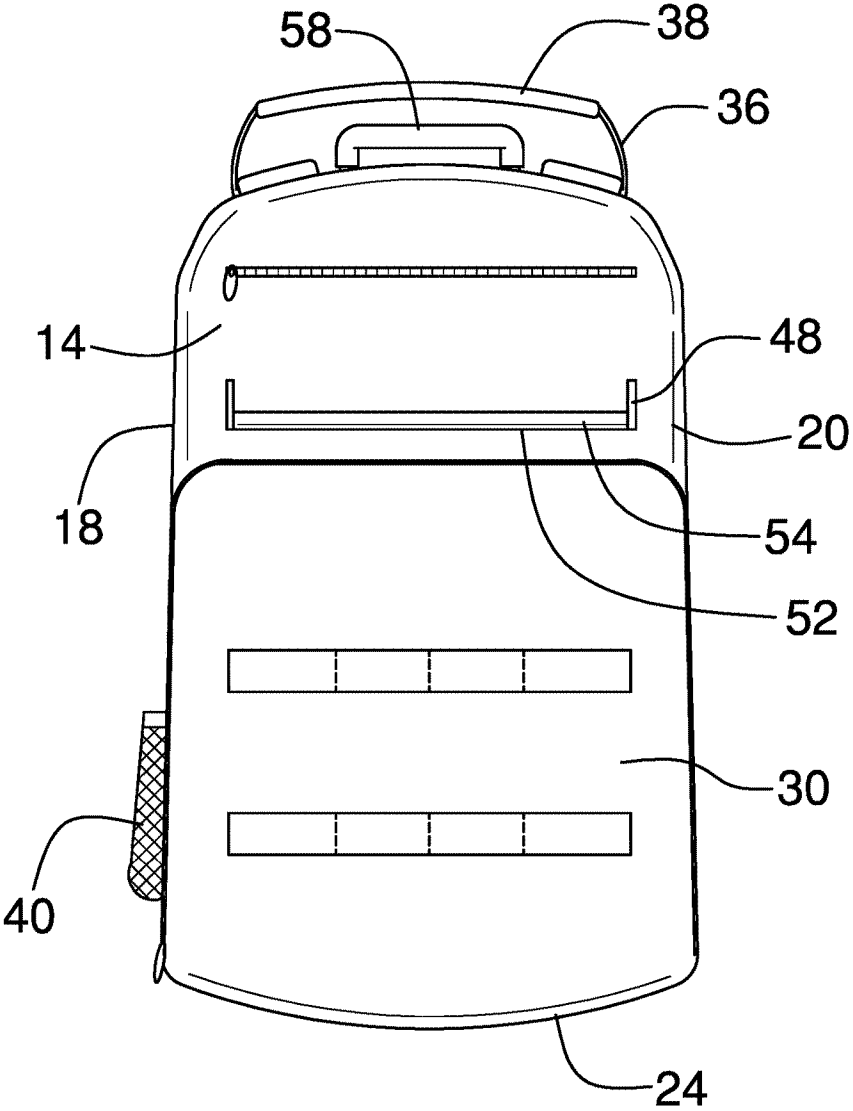
FIG. 3 is a front elevation view of an embodiment of the disclosure.
Figure 6:
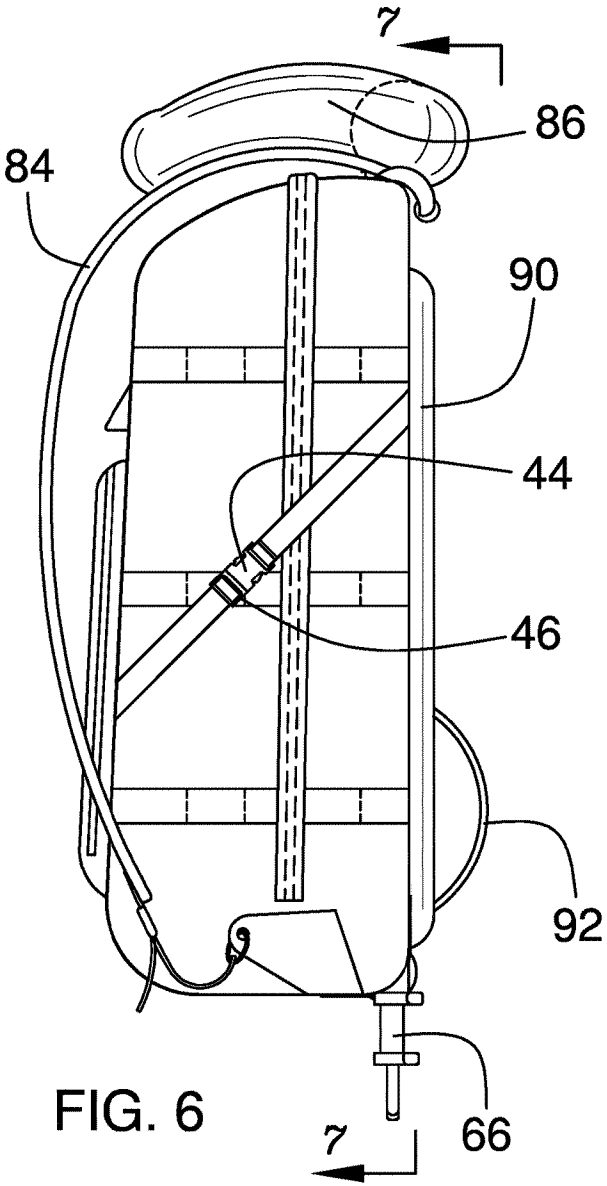
FIG. 6 is a side elevation view of an embodiment of the disclosure.
Figure 5:
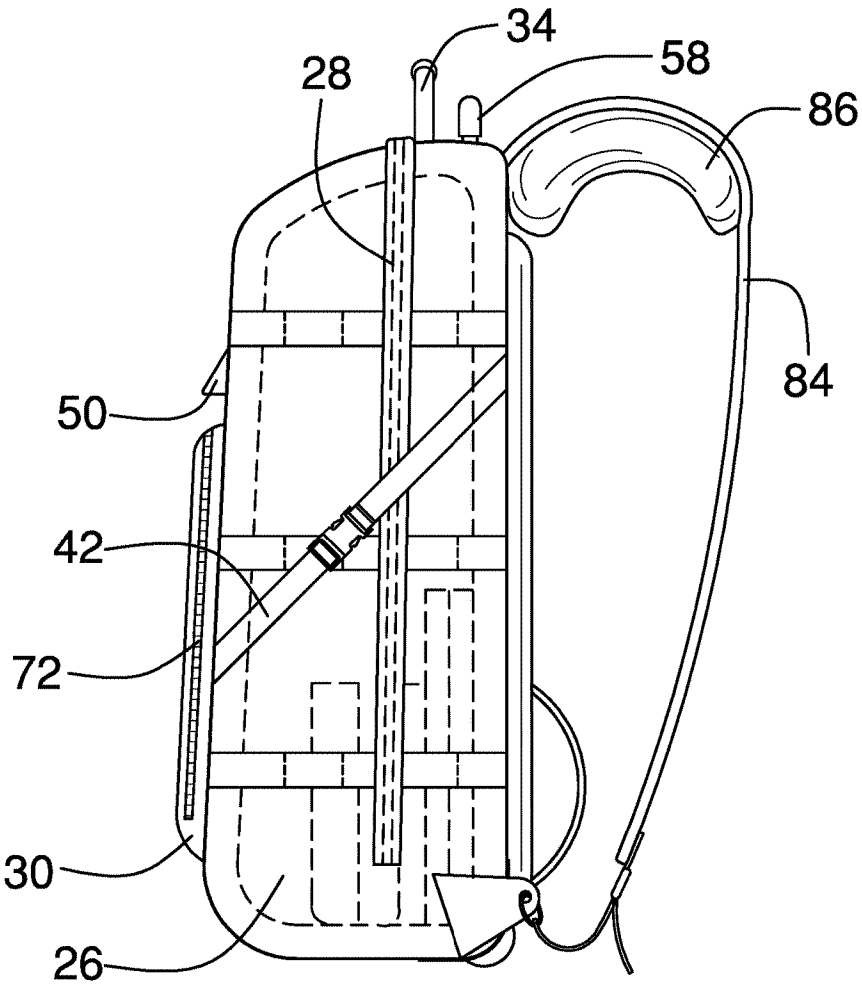
FIG. 5 is a side elevation view of an embodiment of the disclosure.
Figure 7:
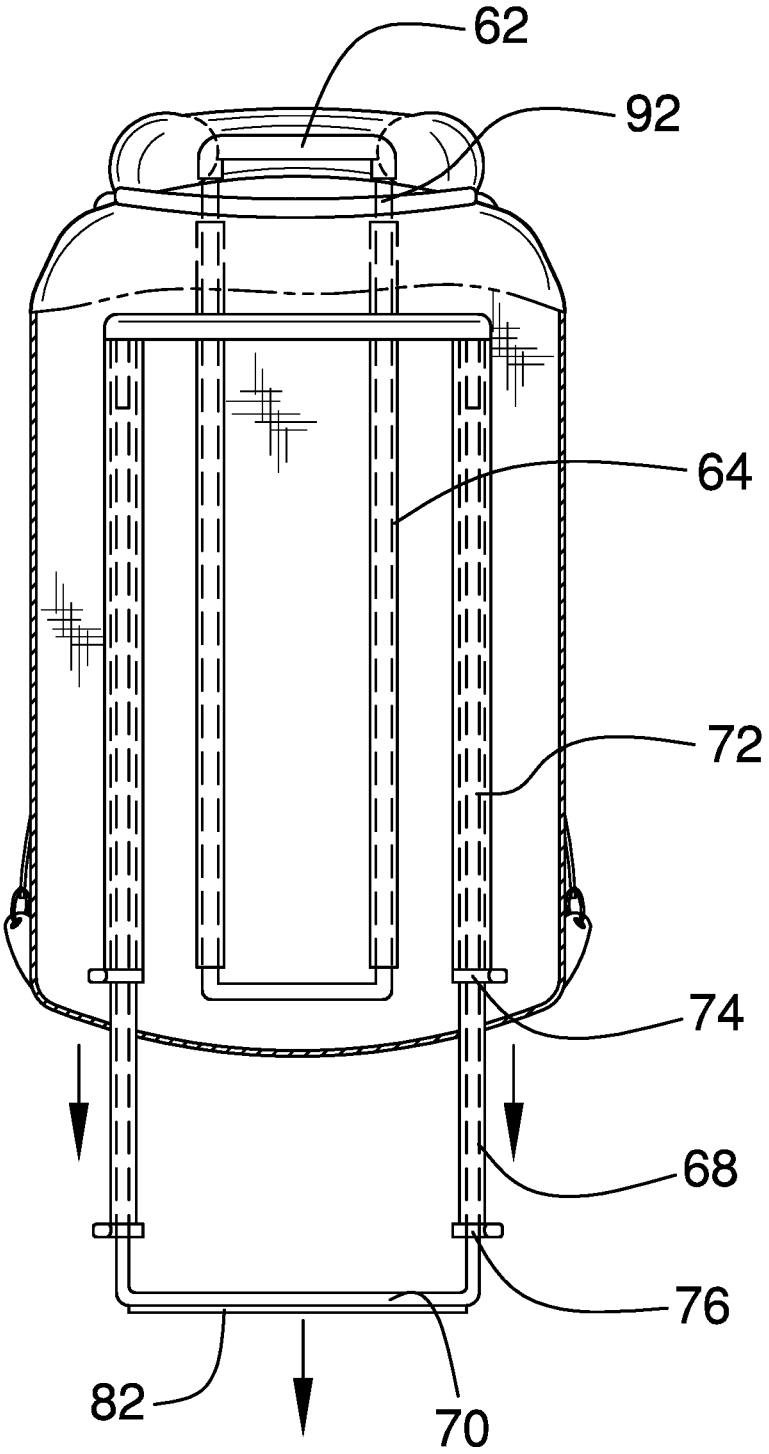
FIG. 7 is a cross-sectional view of an embodiment of the disclosure along line 7-7 of FIG. 6.

With reference now to the drawings, and in particular to FIGS. 1 through 7 thereof, a new backpack embodying the principles and concepts of an embodiment of the disclosure and generally designated by the reference numeral 10 will be described.

As best illustrated in FIGS. 1 through 7, the backpack lap pillow apparatus 10 generally comprises a backpack body 12 having a front side 14 separated from a back side 16, a left side 18 separated from a right side 20, and a top side 22 separated from a bottom side 24 forming an inner cavity 26. The inner cavity 26 has a zippered access aperture 28 extending through the left side 18, the top side 22, and the right side 20 of the backpack body. A front compartment 30 may be coupled to the front side 14 and has a second zippered access aperture 32. A fixed handle 34 comprises a handle strap 36 coupled to the top side 22 and a tubular handle pad 38 coupled around the handle strap 36. The tubular nature of the handle pad 38 provides optimal ergonomics without digging into a user's hand when the inner cavity 26 has heavy contents. A drink holder 40 may be coupled to one of the right side 20 or the left side 18. A pair of reinforcement straps 42 extends at an angle between the front side 14 and the back side 16 across the left side 18 and the right side 20. Each of the pair of reinforcement straps 42 has a buckle 44 and an adjustment mechanism 46. A media shelf 48 is coupled to the front side 14 and is configured to support a mobile electronic device for viewing with the backpack body resting in the user's lap. The media shelf 48 comprises a pair of triangular sides 50 and a support 52 coupled therebetween. The support 52 has a front lip 54 to prevent the mobile electronic device from slipping off.

A pair of wheels 56 is coupled to the back side 16 adjacent the bottom side 24. A retractable handle 58 is coupled to the backpack body 12 to allow the user to comfortably wheel the apparatus 10. The retractable handle 58 comprises a pair of handle posts 60 and a handle grip 62 coupled therebetween. The pair of handle posts 60 is slidingly engageable within a handle track 64 coupled within the back side 16 of the backpack body. A retractable stand 66 is coupled to the backpack body 12 and comprises a pair of stand posts 68 and a foot 70 coupled therebetween. The pair of stand posts 68 is slidingly engageable within a stand track 72 coupled within the back side 16 of the backpack body. The foot 70 of the retractable stand may be wider than the handle grip 62 of the retractable handle, thus making the separation of the stand track 72 thus being greater than the separation of the handle track 64 allowing them to lie coplanar without interference. The stand track 72 has a pair of first locks 74 to engage the pair of stand posts 68 and fix the retractable stand 66. Each of the pair of stand posts 68 is telescopable and has a second lock 76 to fix and alternatively free the telescoping motion. Each of the first locks 74 and the second locks 76 may be a cam lock comprising a collar 78 and a lever 80 with the collar 78 receiving the stand posts 68 and the lever 80 constricting and alternatively loosening the collar 78. The pair of stand posts 68 and the foot 70 are constructed with a rigid metal or plastic material. A non-skid strip 82 made of a more malleable plastic or rubberized material is thus coupled to the foot 70 to prevent the retractable stand 66 from slipping. The retractable stand 66 is positioned so as to prevent the foot 70 from interfering with the pair of wheels 56 when retracted and to support the backpack body 12 at an adjustable height to position the bottom side 24 of the backpack body lap high when the user is seated.

A pair of shoulder straps 84 is coupled to the backpack body 12 and extends from the back side 16 adjacent the top side 22 to the right side 20 and the left side 18 adjacent the bottom side 24. The pair of shoulder straps 84 has a carry position shown in FIGS. 1, 4, and 5 and an alternate rest position shown in FIGS. 2 and 6. The carry position allows the shoulder straps 84 to be worn on the user's shoulders to carry the backpack body 12 and the rest position inverts the pair of shoulder straps 84 such that they extend around the top side 22 and the front side 14 of the backpack body.

A pillow 86 is U-shaped and is coupled to an inner side 88 of each of the pair of shoulder straps 84 proximal the top side 22. The pillow 86 is positioned and arranged such that it wraps around the user's neck when the pair of shoulder straps 84 is worn in the carry position and the pillow 86 rests above the top side 22 of the backpack body when the pair of shoulder straps 84 is in the rest position. A back pad 90 is coupled to the back side 16 and extends from proximal the left side 18 to proximal the right side 20 and from adjacent the bottom side 24 to below the pillow 86 with the straps 84 in the carry position. A cuff 92 is coupled to the back pad 90 and is configured to receive the user's arms.

In use, the backpack body 12 is used to carry contents within the inner cavity 26, either with the pair of shoulder straps 84 in the carry position or by extending the retractable handle 58 and utilizing the pair of wheels 56. To rest, the pair of shoulder straps 84 are inverted to the rest position and the retractable stand 66 is extended and locked using the pair of first locks 74 and the pair of second locks 76 such that the backpack body 12 is supported in, or in front of, the user's lap. The user then hugs the backpack body with the front side 14 oriented towards her chest and rests her head on the pillow 86. The user may optionally insert her arms into the cuff 92 for added comfort and support.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A backpack lap pillow apparatus comprising:

a backpack body having a front side separated from a back side, a left side separated from a right side, and a top side separated from a bottom side forming an inner cavity, the inner cavity having a zippered access aperture extending through the left side, the top side, and the right side of the backpack body;

a pair of shoulder straps coupled to the backpack body, the pair of shoulder straps extending from the back side adjacent the top side to the right side and the left side adjacent the bottom side, the pair of shoulder straps having a carry position and an alternate rest position, the carry position allowing the shoulder straps to be worn on a user's shoulders to carry the backpack body and the rest position inverting the pair of shoulder straps such that they extend around the top side and the front side of the backpack body; and a pillow coupled to the pair of shoulder straps, the pillow being U-shaped and coupled to an inner side of each of the pair of shoulder straps proximal the top side, the pillow being positioned such that it wraps around the user's neck when the pair of shoulder straps is worn in the carry position, the pillow resting above the top side of the backpack body when the pair of shoulder straps is in the rest position.

2. The backpack lap pillow apparatus of claim 1 further comprising a pair of wheels and a retractable handle coupled to the backpack body, the pair of wheels being coupled to the backside adjacent the bottom side, the retractable handle comprising a pair of handle posts and a handle grip coupled therebetween, the pair of handle posts being slidingly engageable within a handle track coupled within the back side of the backpack body.

3. The backpack lap pillow apparatus of claim 1 further comprising a retractable stand coupled to the backpack body, the retractable stand being coupled within the back side of the backpack body and being extendable to support the backpack body at an adjustable height.

4. The backpack lap pillow apparatus of claim 3 further comprising the retractable stand comprising a pair of stand posts and a foot coupled therebetween, the pair of stand posts being slidingly engageable within a stand track coupled within the back side of the backpack body, the stand track having a pair of first locks to engage the pair of stand posts and fix the retractable stand.

5. The backpack lap pillow apparatus of claim 4 further comprising each of the pair of stand posts telescoping, a pair of second locks being coupled to the pair of stand posts to fix and alternatively free the telescoping motion.

6. The backpack lap pillow apparatus of claim 5 further wherein each of the first locks and the second locks is a cam lock comprising a collar and a lever, the collar receiving the stand posts and the lever constricting and alternatively loosening the collar.

7. The backpack lap pillow apparatus of claim 4 further comprising a non-skid strip coupled to the foot.

8. The backpack lap pillow apparatus of claim 1 further comprising a fixed handle coupled to the backpack body, the fixed handle comprising a handle strap coupled to the top side and a tubular handle pad coupled around the handle strap.

9. The backpack lap pillow apparatus of claim 1 further comprising a back pad coupled to the backpack body, the back pad being coupled to the back side and extending from proximal the left side to proximal the right side and from adjacent the bottom side to below the pillow with the straps in the carry position.

10. The backpack lap pillow apparatus of claim 1 further comprising a cuff coupled to the backpack body, the cuff being coupled to the back side of the backpack body and being configured to receive the user's arms.

11. The backpack lap pillow apparatus of claim 9 further comprising a cuff coupled to the back pad, the cuff being configured to receive the user's arms.

12. The backpack lap pillow apparatus of claim 1 further comprising a media shelf coupled to the backpack body, the media shelf being coupled to the front side and configured to support a mobile electronic device.

13. The backpack lap pillow apparatus of claim 12 further comprising the media shelf comprising a pair of triangular sides and a support coupled therebetween, the support having a front lip to prevent the mobile electronic device from slipping.

14. The backpack lap pillow apparatus of claim 1 further comprising a drink holder coupled to one of the right side or the left side of the backpack body.

15. The backpack lap pillow apparatus of claim 1 further comprising a pair of reinforcement straps coupled to the backpack body, the pair of reinforcement straps extending at an angle between the front side and the back side across the left side and the right side, each of the pair of reinforcement straps having a buckle and an adjustment mechanism.

16. The backpack lap pillow apparatus of claim 1 further comprising a front compartment coupled to the backpack body, the front compartment being coupled to the front side and having a second zippered access aperture.

17. A backpack lap pillow apparatus comprising:

a backpack body having a front side separated from a back side, a left side separated from a right side, and a top side separated from a bottom side forming an inner cavity, the inner cavity having a zippered access aperture extending through the left side, the top side, and the right side of the backpack body;

a front compartment coupled to the backpack body, the front compartment being coupled to the front side and having a second zippered access aperture;

a fixed handle coupled to the backpack body, the fixed handle comprising a handle strap coupled to the top side and a tubular handle pad coupled around the handle strap;

a drink holder coupled to one of the right side or the left side of the backpack body;

a pair of reinforcement straps coupled to the backpack body, the pair of reinforcement straps extending at an angle between the front side and the back side across the left side and the right side, each of the pair of reinforcement straps having a buckle and an adjustment mechanism;

a media shelf coupled to the backpack body, the media shelf being coupled to the front side and configured to support a mobile electronic device, the media shelf comprising a pair of triangular sides and a support coupled therebetween, the support having a front lip to prevent the mobile electronic device from slipping;

a pair of wheels coupled to the backpack body, the pair of wheels being coupled to the backside adjacent the bottom side;

a retractable handle coupled to the backpack body, the retractable handle comprising a pair of handle posts and a handle grip coupled therebetween, the pair of handle posts being slidingly engageable within a handle track coupled within the back side of the backpack body;

a retractable stand coupled to the backpack body, the retractable stand comprising a pair of stand posts and a foot coupled therebetween, the pair of stand posts being slidingly engageable within a stand track coupled within the back side of the backpack body;

the stand track having a pair of first locks to engage the pair of stand posts and fix the retractable stand, each of the pair of stand posts telescoping and having a second lock to fix and alternatively free the telescoping motion, each of the first locks and the second locks being a cam lock comprising a collar and a lever, the collar receiving the stand posts and the lever constricting and alternatively loosening the collar;

a non-skid strip coupled to the retractable stand, the non-skid strip being coupled to the foot;

a pair of shoulder straps coupled to the backpack body, the pair of shoulder straps extending from the back side adjacent the top side to the right side and the left side adjacent the bottom side, the pair of shoulder straps having a carry position and an alternate rest position, the carry position allowing the shoulder straps to be worn on a user's shoulders to carry the backpack body and the rest position inverting the pair of shoulder straps such that they extend around the top side and the front side of the backpack body;

a pillow coupled to the pair of shoulder straps, the pillow being U-shaped and coupled to an inner side of each of the pair of shoulder straps proximal the top side, the pillow being positioned such that it wraps around the user's neck when the pair of shoulder straps is worn in the carry position, the pillow resting above the top side of the backpack body when the pair of shoulder straps is in the rest position;

a back pad coupled to the backpack body, the back pad being coupled to the back side and extending from proximal the left side to proximal the right side and from adjacent the bottom side to below the pillow with the straps in the carry position; and a cuff coupled to the back pad, the cuff being configured to receive the user's arms.

18. The backpack lap pillow apparatus of claim 17 further comprising the foot of the retractable stand being wider than the handle grip of the retractable handle, the separation of the stand track thus being greater than the separation of the handle track allowing them to lie coplanar without interference.

19. A backpack lap pillow apparatus comprising:

a backpack body having a front side separated from a back side, a left side separated from a right side, and a top side separated from a bottom side forming an inner cavity, the inner cavity having a zippered access aperture extending through the left side, the top side, and the right side of the backpack body;

a front compartment coupled to the backpack body, the front compartment being coupled to the front side and having a second zippered access aperture;

a fixed handle coupled to the backpack body, the fixed handle comprising a handle strap coupled to the top side and a tubular handle pad coupled around the handle strap;

a drink holder coupled to one of the right side or the left side of the backpack body;

a pair of reinforcement straps coupled to the backpack body, the pair of reinforcement straps extending at an angle between the front side and the back side across the left side and the right side, each of the pair of reinforcement straps having a buckle and an adjustment mechanism;

a media shelf coupled to the backpack body, the media shelf being coupled to the front side and configured to support a mobile electronic device, the media shelf comprising a pair of triangular sides and a support coupled therebetween, the support having a front lip to prevent the mobile electronic device from slipping;

a pair of wheels coupled to the backpack body, the pair of wheels being coupled to the backside adjacent the bottom side;

a retractable handle coupled to the backpack body, the retractable handle comprising a pair of handle posts and a handle grip coupled therebetween, the pair of handle posts being slidingly engageable within a handle track coupled within the back side of the backpack body;

a retractable stand coupled to the backpack body, the retractable stand comprising a pair of stand posts and a foot coupled therebetween, the pair of stand posts being slidingly engageable within a stand track coupled within the back side of the backpack body, the foot of the retractable stand being wider than the handle grip of the retractable handle, the separation of the stand track thus being greater than the separation of the handle track allowing them to lie coplanar without interference;

the stand track having a pair of first locks to engage the pair of stand posts and fix the retractable stand, each of the pair of stand posts telescoping and having a second lock to fix and alternatively free the telescoping motion, each of the first locks and the second locks being a cam lock comprising a collar and a lever, the collar receiving the stand posts and the lever constricting and alternatively loosening the collar;

a non-skid strip coupled to the retractable stand, the non-skid strip being coupled to the foot;

a pair of shoulder straps coupled to the backpack body, the pair of shoulder straps extending from the back side adjacent the top side to the right side and the left side adjacent the bottom side, the pair of shoulder straps having a carry position and an alternate rest position, the carry position allowing the shoulder straps to be worn on a user's shoulders to carry the backpack body and the rest position inverting the pair of shoulder straps such that they extend around the top side and the front side of the backpack body;

a pillow coupled to the pair of shoulder straps, the pillow being U-shaped and coupled to an inner side of each of the pair of shoulder straps proximal the top side, the pillow being positioned such that it wraps around the user's neck when the pair of shoulder straps is worn in the carry position, the pillow resting above the top side of the backpack body when the pair of shoulder straps is in the rest position;

a back pad coupled to the backpack body, the back pad being coupled to the back side and extending from proximal the left side to proximal the right side and from adjacent the bottom side to below the pillow with the straps in the carry position; and a cuff coupled to the back pad, the cuff being configured to receive the user's arms.

* * * * *